US007063219B2

(12) United States Patent
Fann et al.

(10) Patent No.: US 7,063,219 B2
(45) Date of Patent: Jun. 20, 2006

(54) ADJUSTABLE WINE RACK

(75) Inventors: Billy Ray Fann, Greenwood, MS (US); Ray Nilssen, Greenwood, MS (US); Kim Harris, Greenwood, MS (US); Martin Wesemann, Greenwood, MS (US)

(73) Assignee: Viking Range Corporation, Greenwood, MS (US)

( * ) Notice: Subject to any disclaimer, the term of this patent is extended or adjusted under 35 U.S.C. 154(b) by 1 day.

(21) Appl. No.: 10/357,236

(22) Filed: Feb. 3, 2003

(65) Prior Publication Data

US 2004/0149668 A1 Aug. 5, 2004

(51) Int. Cl.
*A47F 7/00* (2006.01)

(52) U.S. Cl. ..... 211/74; 211/126.15; 211/150

(58) Field of Classification Search ..... 211/80, 211/81, 126.15, 130.1, 144, 151, 168, 170, 211/74, 75, 77, 150, 90.03, 59.2; 312/116, 312/119, 120, 122, 123, 133; 248/455, 456
See application file for complete search history.

(56) References Cited

U.S. PATENT DOCUMENTS

| | | | | | |
|---|---|---|---|---|---|
| 2,005,938 | A | * | 6/1935 | Graves | 248/128 |
| 4,022,327 | A | | 5/1977 | Anderson | 211/74 |
| 4,023,681 | A | | 5/1977 | Plant | 211/74 |
| 4,093,076 | A | | 6/1978 | Newton | 211/74 |
| 4,220,245 | A | | 9/1980 | Corcoran | 211/49 |
| 4,460,221 | A | | 7/1984 | Dimino | 312/277 |
| 4,515,334 | A | | 5/1985 | Horne | 248/146 |
| 4,546,883 | A | | 10/1985 | Youngdale | 206/521 |
| 4,577,765 | A | | 3/1986 | Crosby | 211/75 |
| 4,646,658 | A | * | 3/1987 | Lee | 211/184 |
| 4,660,727 | A | | 4/1987 | Levine | 211/74 |
| 4,662,523 | A | | 5/1987 | Stein et al. | |
| 4,678,247 | A | * | 7/1987 | Pink | 312/116 |
| 4,700,849 | A | | 10/1987 | Wagner | 211/71 |
| 4,715,503 | A | | 12/1987 | Johnson | 211/74 |
| 4,775,201 | A | * | 10/1988 | Thomson | 312/248 |
| 4,936,641 | A | | 6/1990 | Bussan et al. | 312/214 |
| 4,998,631 | A | | 3/1991 | Fridjhon | 211/74 |
| 5,150,784 | A | | 9/1992 | Sayad | 206/202 |
| 5,180,066 | A | | 1/1993 | McArdle | 211/74 |
| 5,244,272 | A | * | 9/1993 | Thompson | 211/80 |
| 5,323,917 | A | | 6/1994 | Johnson et al. | 211/74 |
| 5,344,033 | A | * | 9/1994 | Herman | 211/126.1 |
| 5,490,600 | A | | 2/1996 | Bustos | |
| 5,558,236 | A | | 9/1996 | Williams et al. | 211/74 |
| 5,711,436 | A | | 1/1998 | Moeller et al. | 211/94.5 |
| 5,813,741 | A | * | 9/1998 | Fish et al. | 211/153 |
| 5,826,731 | A | | 10/1998 | Dardashti | 211/74 |
| 5,947,305 | A | | 9/1999 | Lin | 211/74 |
| 6,003,693 | A | | 12/1999 | Blickenstaff | 211/74 |

(Continued)

FOREIGN PATENT DOCUMENTS

EP 1 156 290 A1 11/2001

*Primary Examiner*—Jennifer E. Novosad
(74) *Attorney, Agent, or Firm*—Womble Carlyle Sandridge & Rice, PLLC

(57) ABSTRACT

An adjustable wine rack supports one or more wine bottles in a substantially horizontal or inclined position. The adjustable wine rack generally includes a frame that may be rollably disposed within a refrigerator. The frame supports a bottle support that is adjustable from a substantially horizontal position to an inclined position. A prop is also connected to the frame and engages the bottle support so as to maintain the bottle support in the inclined position.

6 Claims, 5 Drawing Sheets

U.S. PATENT DOCUMENTS 6,039,422 A * 3/2000 Butters et al. ..... 211/181.1
6,050,104 A 4/2000 Corona
6,361,129 B1 3/2002 Börgen ..... 312/128
6,386,393 B1 * 5/2002 Paulovich et al. ..... 211/80
6,454,108 B1 * 9/2002 Gerard ..... 211/74
6,619,609 B1 * 9/2003 Cress ..... 248/447

* cited by examiner

ADJUSTABLE WINE RACK

TECHNICAL FIELD

The present invention is directed to a refrigerator and refrigerator components, and specifically to a refrigerator configured for wine bottles, and to adjustable racks and shelving for storing wine bottles in a refrigerator.

BACKGROUND

Refrigerators designed to store wine bottles have storage racks that are mounted to be fixed in either an inclined or a horizontal position. Some refrigeration storage units include both horizontal and inclined racks which are fixed in only one configuration. Wine racks that are in a fixed configuration limit the user's flexibility in storing wine. While fixed inclined racks allow the user to store wine bottles in an inclined position, these racks require more space within the refrigerator than horizontally aligned racks. Also, when wine bottles are displayed on these inclined racks with the corks up, the corks tend to dry out since the wine is not in contact with the corks. Horizontal wine racks provide greater storage capacity and better storage conditions for wine corks, but fail to offer the user the capability to display the wine bottles within the refrigerator.

Consequently, it is desirable to provide a wine rack that is adjustable from a horizontal to an inclined position to provide the user the option of displaying wine bottles, while optimizing the storage capacity and conditions of the refrigerator.

SUMMARY

The adjustable wine rack of the present invention includes a bottle support or rack that is movable from a substantially horizontal position to a select inclined position. The wine rack includes a prop, operably connected to the bottle support, which maintains the bottle support in the inclined position. The adjustable wine rack is mounted within the refrigerator to provide flexibility in storing the wine bottles. The wine rack may be removably mounted within the refrigeration unit for furtherflexibility in positioning the rack and for ease of adjustment between a substantially horizontal position and an inclined position.

In one embodiment, the adjustable wine rack includes a bottle support adjustably mounted to a frame. The bottle support is comprised of a plurality of inter-connected rods that support one or more wine bottles. The bottle support is connected to the frame by a pivot pin or rod that secures the bottle support to the frame and allows the frame to be pivotally rotated. The frame includes flanges and/or rollers that allow for insertion and removal of the frame from the refrigerator by sliding and/or rolling the frame. The adjustable wine rack also includes a prop that supports the bottle support in a selected inclined position. The prop is pivotally connected to the frame by pins or feet. When the bottle support is to be placed in an inclined position, the prop is rotated to be operably connected to the bottle support to maintain the support in the inclined position. The prop may be connected to the bottle support by positioning a cross-bar of the support in engagement with one or more stops or catches formed on the bottle support.

The present invention also includes a wine refrigerator which incorporates the novel adjustable wine rack. Wine bottles may be selectively stored in the refrigerator using the adjustable wine rack in a horizontal position, inclined position or vertical position. The rack may be either rollably or slidably removed from the refrigerator to facilitate the adjustment of the bottle support between the various positions. These and other aspects of the present invention are set forth in greater detail in the description below and in the accompanying drawing figures:

DETAILED DESCRIPTION

Figure 1:
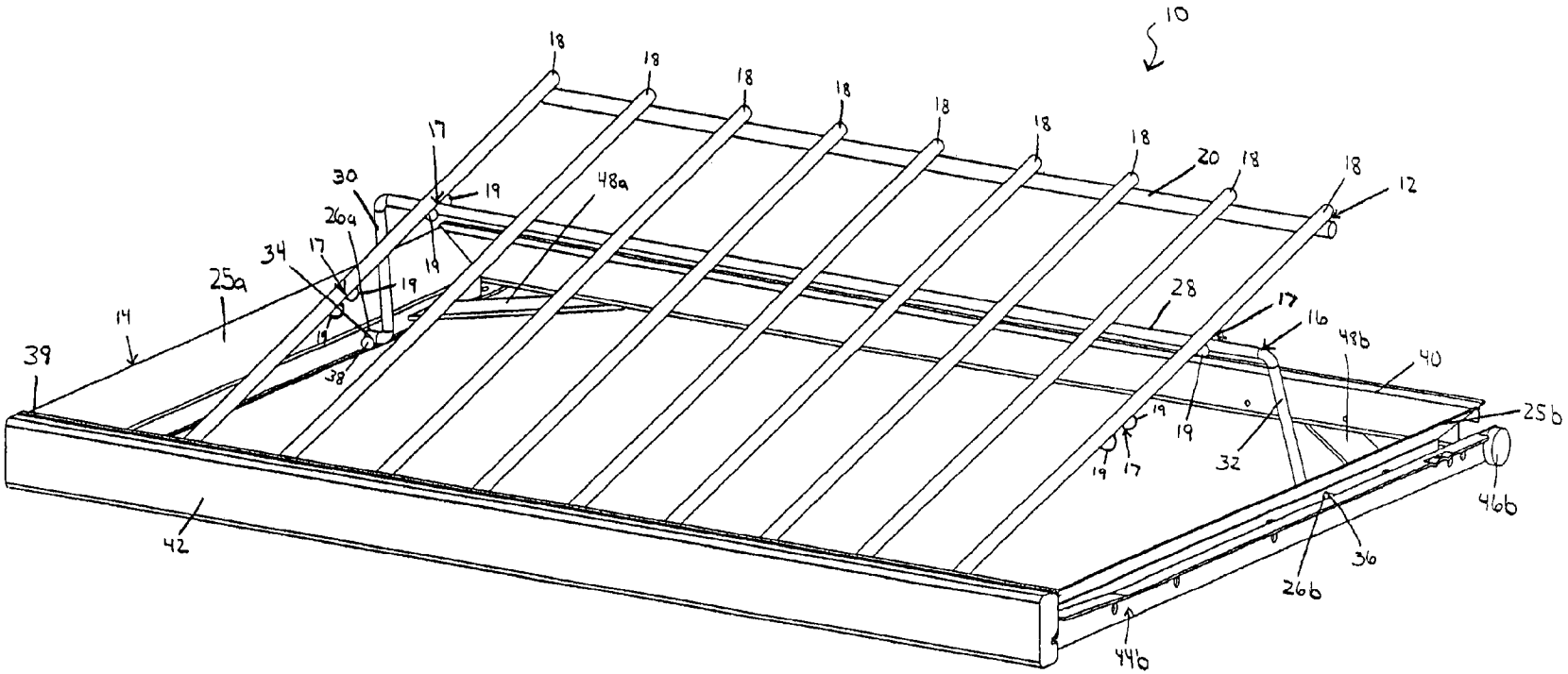
FIG. 1 is a perspective view of an adjustable wine rack of the present invention.
Figure 3:
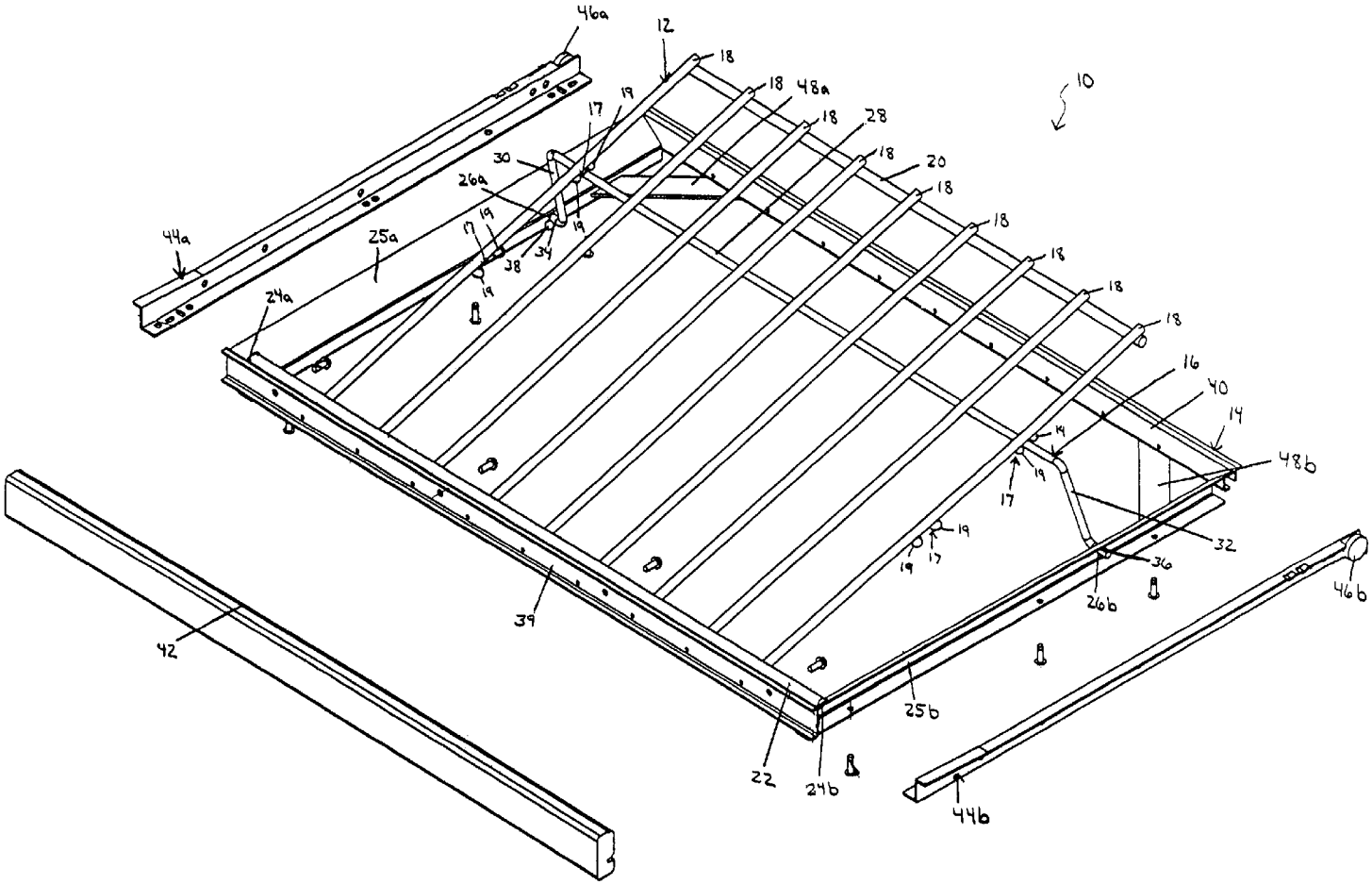
FIG. 3 is a partially exploded perspective view of the adjustable wine rack of FIG. 1.
Figure 4:
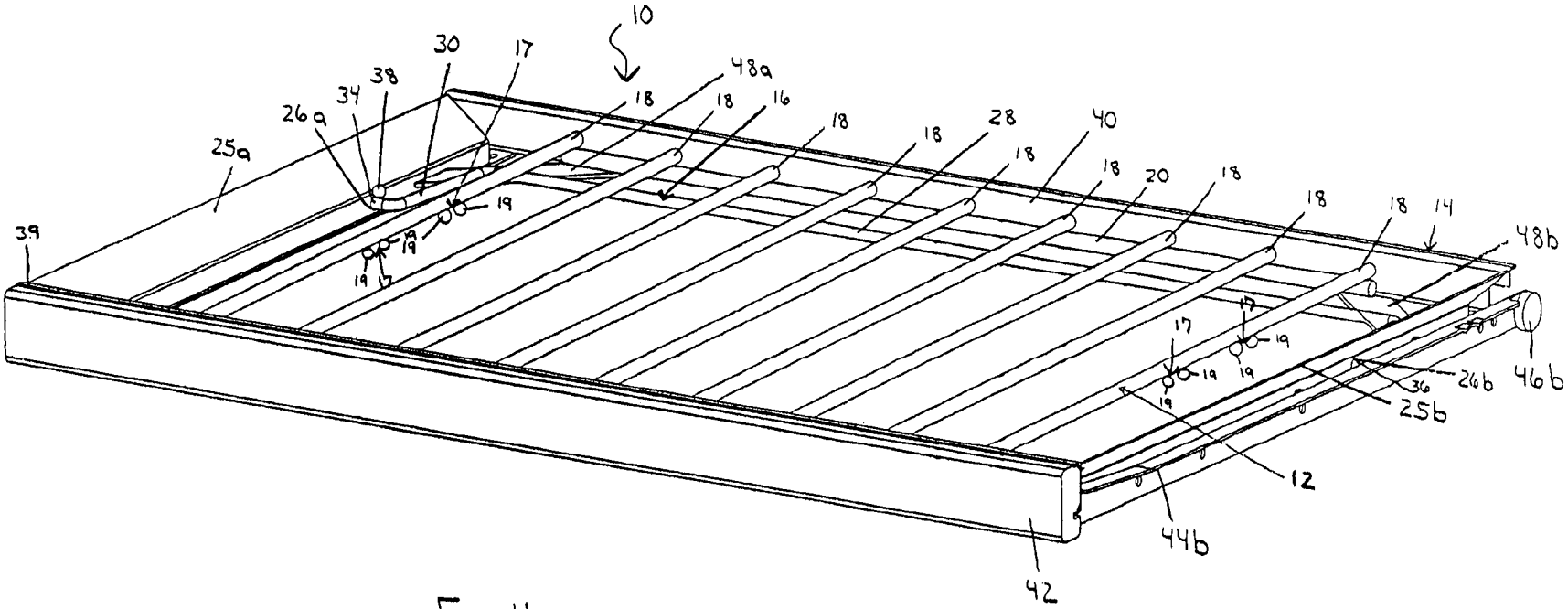
FIG. 4 is a perspective view of the adjustable wine rack of FIG. 1 with the bottle support in a substantially horizontal position.
Figure 5:
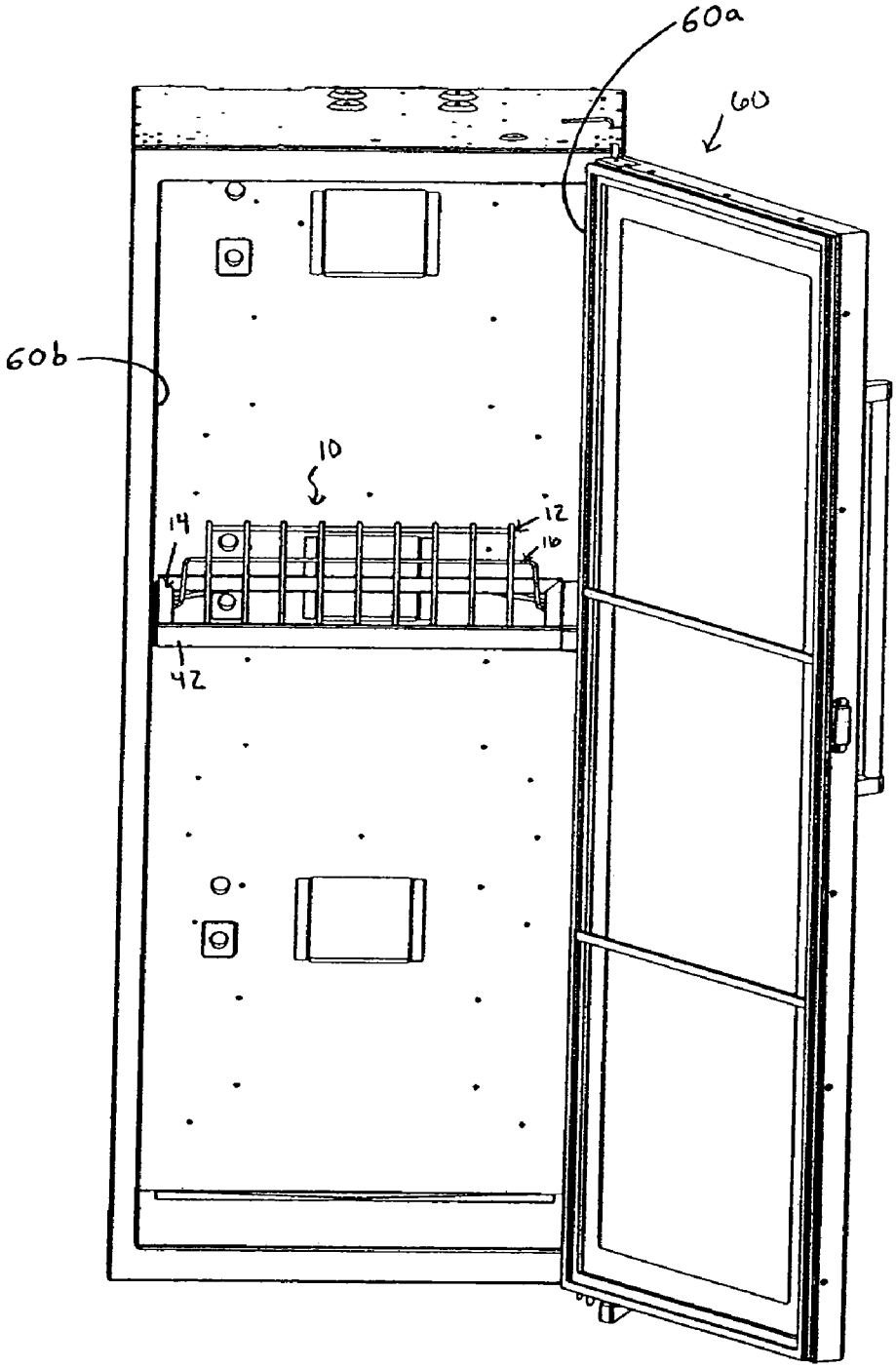
FIG. 5 is a perspective view of the refrigerator of the present invention, which incorporates the adjustable wine rack of FIG. 1.

Referring to the drawings, FIGS. 1–5, in which like numerals refer to like parts throughout the several views, FIG. 1 depicts an adjustable wine rack 10 that includes a bottle support 12. The bottle support 12 is adjustable between an inclined position, FIG. 1, and a substantialy horizontal position, FIG. 4. As used herein, the term "substantially horizontal" refers to the orientation of the bottle support such that a wine bottle supported on its side is sufficiently horizontal to allow the wine within an unopened bottle of wine to contact the cork. The bottle support 12 is pivotally mounted to a frame 14 that is mounted within the refrigerator 60, as shown in FIG. 5. A prop or brace 16 also is pivotally mounted to the frame 14, and may be adjustably positioned to engage and maintain the bottle support 12 in a selected inclined position. The prop 16 also can help to support the bottle support 12, while it is in a substantially horizontal position. The adjustable positioning of the bottle support 12 allows a user to store wine in a horizontal position within a refrigerator or store and display the wine in a selected inclined position.

As shown in FIGS. 1 and 3, the bottle support 12 of the adjustable wine rack 10 includes a plurality of rods 18 that are spaced from and parallel to one another. These rods 18 are inter-connected by a cross-bar 20 and a pivot rod 22. These rods referred to herein may include not only an elongated rod, circular in cross-section, but also may include any support member providing the necessary structural support along its length, such as a bar, bracket, pin, shaft or other support. The pivot rod 22 connects the bottle support 12 to the frame 14. The rods 18 generally are spaced apart and aligned parallel to each other so as to support the cylindrical sides of the wine bottles that are to be stored thereon. The present invention, however, also encompasses alternative configurations for the bottle receiving surfaces of the bottle supports 12. For example, the bottle support 12 may include inter-connected bands, bars or even a sheet of material to provide the primary support surface on which to store wine. Alternative inter-connections of the rods 18 from that shown in the drawing figures also are encompassed by the present invention. The rods 18 typically are resistant-welded metal. However, the bottle support 12 also may be formed of molded plastic, composite or wood components, or a one-piece molded structure.

Each end of the pivot rod 22 is inserted into apertures 24*a* and 24*b* formed in the side beams 25*a* and 25*b* of the frame 14. The prop 16 also defines prop apertures 26*a* and 26*b* formed in side beams 25*a* and 25*b*, which are spaced from the rod 22 as shown in FIG. 3. The prop 16 includes cross-bar 28 from which extends a first leg 30 and a second leg 32. First and second legs 30 and 32 extend from opposing ends of cross-bar 28 and terminate with L-shaped foot 34 and L-shaped foot 36, respectively. The ends of the first and second feet 34 and 36 extend through the prop apertures 26*a* and 26*b*, respectively, thereby allowing for pivotal rotation of prop 16 about an axis extending through prop apertures 26*a* and 26*b*. Each foot 34 and 36 includes a stop 38 attached thereto. Each stop 38 cooperates with a portion of side beam 25*a* or 25*b*, to limit the range of rotation of the prop 16 about the axis extending through prop apertures 26*a* and 26*b*. Stops 38 may allow the prop 16 to be rotated downward in one direction, but prevent its rotation past the position in which the prop 16 engages and maintains the bottle support 12 in the inclined position.

Figure 2:
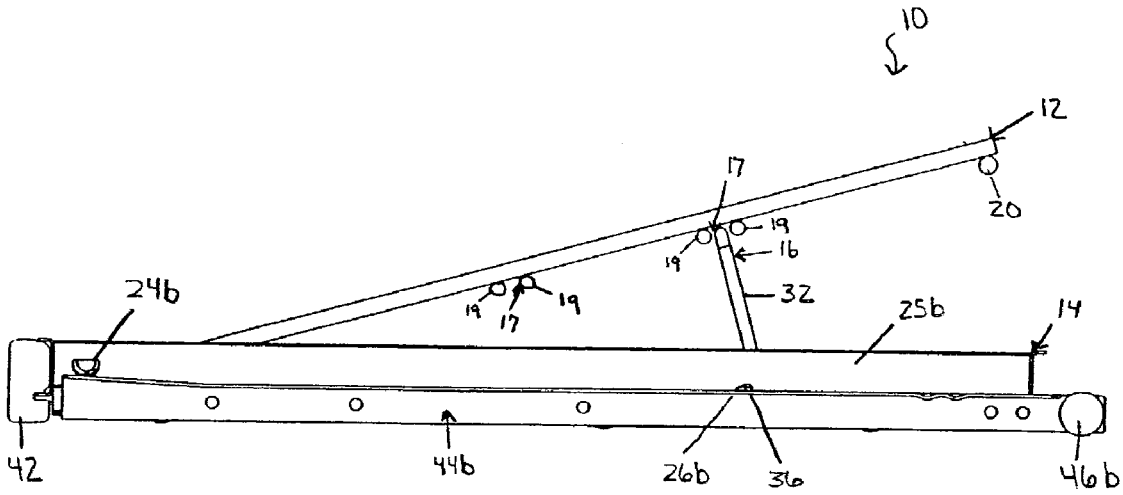
FIG. 2 is a side view of the adjustable wine rack of FIG. 1.

Bottle support 12 also includes one or more catches 17 that engage the crossbar 28 of prop 16. As shown in FIG. 2, each catch 17 comprises a pair of bosses 19 spaced apart to receive the cross-bar 28 of prop 16 therebetween. The prop 16 may be positioned to engage different catches 17 spaced along the bottle support 12, so as to allow for selective adjustment and positioning of the bottle support 12 in varied inclined positions.

As shown in FIGS. 1 and 3, the frame 14 includes side beams 25*a* and 25*b*, to which are connected front beam 39 and rear beam 40. The frame 14 preferably is made of a structurally competent material, such as sheet metal, molded plastic or other suitable material. The frame 14 is designed to encompass the bottle support 12 and mount it within a refrigerator. Front beam 39 is disposed toward the front of the refrigerator, while rear beam 40 is positioned toward the rear of the refrigerator. As shown in FIG. 3, a decorative face piece 42 can be attached to the front beam 39 of the frame 14. The face piece 42 may be formed of plastic, metal or other suitable material and have a finish and design that enhances the aesthetics of the adjustable wine rack 10 and the refrigerator. Roller glides 44*a* and 44*b* are attached to side beams 25*a* and 25*b*. The roller glides 44*a* and 44*b* allow the adjustable wine rack 10 to be moved, at least partially, out of the refrigerator. The roller glides 44*a* and 44*b*, on which rollers 46*a* and 46*b* are mounted, respectively, are configured to engage brackets, flanges, ledges or similar structures, not shown, disposed within the refrigerator along the opposed, right and left inner side walls 60*a* and 60*b*. It is well known in the art to provide an elongated bracket or ledge along a refrigerator's inner side wall to support a slidable shelf. Alternatively, the adjustable wine rack 10 may include shoulders, flanges, brackets or other suitable structures (not shown) formed on the frame 14 to mount the frame 14 within the refrigerator 60.

Gussets 48*a* and 48*b* are attached to and extend between the side beams 25*a* and 25*b* and the rear beam 40. The gussets 48*a* and 48*b* provide additional support and stability to the frame 14 and to the bottle support 12.

Some or all of the previously described components may be formed of metal, plastic composite, wood or other suitable material. In the case of metal components, some or all of the above portions of the adjustable wine rack 10 may be coated with a flexible polymeric coating that protects the component from corrosion, as well as protecting the wine bottles that are stored on the adjustable wine rack 10.

While one embodiment of the adjustable wine rack is set forth within the drawing figures, the present invention encompasses alternative embodiments that provide an adjustable wine rack that supports wine bottles in alternate, substantially horizontal and inclined positions. For example, the bottle support may be attached by hinges to the frame 14 to allow the bottle support to move from a substantially horizontal to an inclined position. The prop 16 also may comprise an arm disposed at the center of the rear beam of the frame and include one or more slots that can receive the cross bar or other portion of the bottle support and maintain the bottle support in an inclined position. In yet another embodiment, the prop may comprise one or more adjustable members attached to the support and configured to be adjustably positioned to maintain the bottle support in an inclined position. Further still, the adjustable wine rack may comprise a pivot rod connected to the center portions of the side beams and the bottle support, allowing the bottle support to rotate about an axis extending through the center of the frame. In this embodiment, the prop is attached to the frame and can engage the rotated bottle support so as to maintain it in an inclined position. In use, the adjustable wine rack 10 may be rolled into position within a refrigerator, as shown in FIG. 5, by the engagement of the roller glides 44*a* and 44*b* within a mounting bracket disposed within the refrigerator. When the bottle support 12 is in a substantially horizontal position, as shown in FIG. 4, one or more wine bottles are placed on the bottle support 12 on their sides. Accordingly, the wine bottles may be stored within the refrigerator in a substantially horizontal position. When the user desires to display one or more wine bottles within the refrigerator, the adjustable wine rack 10 is at least partially roll ably removed from the refrigerator. The bottle support 12 is then pivotally rotated about an axis extending through pivot rod 22 into an inclined position. The prop 16 also is pivoted so that the cross beam 28 of prop 16 engages the catches 17 formed on the rods 18 of the bottle support 12. Specifically, the cross beam 28 is disposed between the bosses 19 of one set of catches 17 to secure the engagement of prop 16 with the bottle support 12. The prop 16 thereby structurally supports and maintains the bottle support 12 in a selected inclined position. The adjustable wine rack 10 may then be rolled back into the refrigerator and one or more bottles of wine placed on the bottle support 12 and displayed in the selected inclined position.

It is to be understood that the above embodiments were provided by way of example only and are not to be construed to limit the present invention to only those aspects thereof. The present invention encompasses modifications and alterations made by those of ordinary skill in the art to the disclosed embodiments.

What is claimed is:

1. An adjustable wine rack for a refrigerator comprising:

a frame;

a bottle support pivotally mounted on said frame and which is pivotable from a substantially horizontal position to an inclined position;

a prop pivotally connected to said frame, for maintaining said borne support in the inclined position;

stop means connected to said prop adjacent said frame for limiting pivoting movement of said prop; and mounting means on said frame for connecting said rack to the interior of said refrigerator.

2. The adjustable wine rack of claim 1, wherein said mounting means includes a glide roller attached to said frame.

3. The adjustable wine rack of claim 1, wherein said bottle support comprises a pivot rod connecting said bottle support to said frame and wherein a plurality of interconnected rods are connected to said pivot rod.

4. The adjustable wine rack of claim 1, wherein said bottle support further comprises a catch, wherein said catch engages said prop when said prop is operably connected to said bottle support to maintain said bottle support in an inclined position.

5. The adjustable wine rack of claim 4 wherein said catch includes bosses formed in said bottle support to engage said prop.

6. The adjustable wine rack of claim 5 further including a plurality of bosses on said bottle support, spaced along said bottle support for positioning said prop in a plurality of inclined positions.

* * * * *